US006303017B1

(12) United States Patent
Page et al.

(10) Patent No.: US 6,303,017 B1
(45) **Date of Patent: *Oct. 16, 2001**

(54) CATHODIC PROTECTION OF REINFORCED CONCRETE

(75) Inventors: Christopher L. Page; George Sergi, both of Birmingham (GB)

(73) Assignee: Aston Material Services Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/377,920

(22) Filed: Aug. 20, 1999

Related U.S. Application Data

(63) Continuation-in-part of application No. 08/448,586, filed on Aug. 9, 1995, now Pat. No. 6,022,469.

(30) Foreign Application Priority Data

Jun. 16, 1993 (GB) ..... 9312431
Jun. 6, 1994 (WO) ..... PCT/GB94/01224

(51) Int. Cl.[7] ..... C23F 13/00

(52) U.S. Cl. ..... 205/734; 205/730; 205/731; 205/732; 205/733; 205/735; 204/196.01; 204/196.21; 204/196.25; 204/196.36

(58) Field of Search ..... 205/730–735; 204/196.01, 196.21, 196.25, 196.36

(56) References Cited

U.S. PATENT DOCUMENTS

| | | | |
|---|---|---|---|
| 1,269,926 | 6/1918 | Gesell | 204/197 |
| 2,565,544 | 8/1951 | Brown | 204/197 |
| 3,488,275 | 1/1970 | Loyd | 204/197 |
| 4,435,264 | 3/1984 | Lau | 204/197 |
| 4,692,066 | 9/1987 | Clear | 204/196.01 |
| 5,254,228 | 10/1993 | Westhof et al. | 204/196.01 |
| 5,292,411 | 3/1994 | Bartholomew et al. | 204/196.01 |
| 6,022,469 * | 2/2000 | Page | 205/734 |

FOREIGN PATENT DOCUMENTS

| | | |
|---|---|---|
| 0 499 437 | 8/1992 | (EP) . |
| 7608443 | 1/1978 | (NL) . |
| WO 93/12052 | 6/1993 | (WO) . |
| WO 94/29496 | 12/1994 | (WO) . |

OTHER PUBLICATIONS

Balkwill and Sykes; "Simulating the Pitting Corrosion of Steel Reinforcement in Concrete"; ASTM/NPL Conference on the Use of Synthetic Environments for Corrosion Testing at the National Physical Laboratory; Teddington; Feb. 1986.

Page; "Mechanism of Corrosion Protection in Reinforced Concrete Marine Structures"; Nature vol. 258, No. 5595; Dec. 1975; pp. 514–515.

Foller, "*Effects of Additives on the Suspension of Products of Discharge of Zinc in Alkaline Solution*"; *Journal of Applied Electrochemistry,* vol. 17 (1987), pp. 1296–1303, No month available.

Page et al, "*Developments in Cathodic Protection Applied to Reinforced Concrete*"; Manuscript submitted to *Journal of Materials in Civil Engineering* ; (not yet published); pp. 1–28, No month/year available.

(List continued on next page.)

*Primary Examiner*—Bruce F. Bell
(74) *Attorney, Agent, or Firm*—Nixon & Vanderhye PC

(57) ABSTRACT

Reinforcement in concrete is cathodically protected by galvanically connecting a sacrificial anode, such as a zinc or zinc alloy anode, to the reinforcement, and contacting the anode with an electrolyte solution having a pH which is maintained sufficiently high for corrosion of the anode to occur, and for passive film formation on the anode to be avoided. The pH of the electrolyte is preferably at least 0.2 units, and preferably from 0.5 units to more than 1.0 units, above the pH value at which passivity of the anode would occur. The electrolyte may be for example sodium hydroxide or potassium hydroxide but is preferably lithium hydroxide which also acts as an alkali-silica reaction inhibitor.

26 Claims, 1 Drawing Sheet

OTHER PUBLICATIONS

McCurrich et al., "Repair Systems for Preventing Further Corrosion in Damaged Reinforced Concrete," 1st International Conference Deterioration and Repair of Reinforced Concrete in the Arabian Gulf; Oct. 26–29, 1985; pp. 151–168.

Hardon, PhD Thesis, "Technology of Repair for Corroded Reinforced Concrete"; Aston University; 1989.

Andrade et al, "Relation between the alkali content of cements and the corrosion rates of the galvanized reinforcements"; *Corrosion of Reinforcement in Concrete Construction*; 1983; pp. 343–355.

Sergi et al; "Corrosion of Galvanized and Galvannealed Steel in Solutions of pH 9.0 to 14.0"; Corrosion; vol. 41, No. 11, 1985; pp. 618–624.

Page et al, "Corrosion Behaviour of Zinc Coated Steel in Silica Fume Concrete"; *Fly Ash, Silica Fume, Slag, and Natural Pozzolans in Concrete; Proceedings Third International Conference*, Trondheim, Norway, 1989; vol. 2; SP 114–43; pp. 887–896.

* cited by examiner

CATHODIC PROTECTION OF REINFORCED CONCRETE

This application is a continuation in part of U.S. application Ser. No. 08/448,586, filed Aug. 9, 1995, now U.S. Pat. No. 6,022,469, the entire disclosure of which is incorporated herein by this reference, and which was the national phase of international application PCT/GB94/01224, filed Jun. 6, 1994, which designated the U.S.

BACKGROUND OF THE INVENTION

1. Field of the Invention

This invention relates to the cathodic protection of reinforced concrete.

2. Description of the Related Art

The application of cathodic protection to steel reinforcement in concrete is an accepted method of providing corrosion protection for the metal, particularly where chloride ions are present at significant concentrations in the concrete.

Cathodic protection involves the formation of a circuit with the reinforcement acting as a cathode, electrically connected to an anode, with the circuit being completed by pore solution in the concrete and an electrolyte contacting the anode. When a potential difference exists corrosion of the cathode is prevented or reduced.

It is known to create a potential difference between anode and cathode both by means of impressed current cathodic protection which involves the use of a non-sacrificial anode and an applied electric current using an external DC power supply and by means of a galvanic cell in which the potential arises as a result of the different materials forming a sacrificial anode and a cathode.

Where a galvanic cell is used it is important that the electrolyte contacting the anode is such that sustained active corrosion of the anode can occur. If suitable conditions are not maintained then the cathodic protection will become inefficient.

Furthermore, the electrolyte must be such that its contact with the surrounding concrete does not result in the degradation of the concrete. Of particular significance in this context is the susceptibility of some aggregates, present in concrete, to alkali-silica or alkali-agggregate reactions. These reactions can cause swelling and consequential cracking of concrete.

SUMMARY OF THE INVENTION

According to the invention there is provided a method of cathodically protecting reinforcement in concrete in which a sacrificial anode is galvanically connected to the reinforcement characterised in that the anode is contacted with an electrolyte solution having a pH which is maintained sufficiently high for corrosion of the anode to occur and for passive film formation on the anode to be avoided.

According to a further feature of the invention there is provided a unit for use in the cathodic protection of reinforcement in concrete by the method of claim 1 characterised in that the unit comprises a sacrificial anode in contact with a material containing an electrolyte which in solution has a pH which is sufficiently high for corrosion of the anode to occur and for passive film formation on the anode to be avoided when the anode is galvanically connected to the reinforcement.

According to yet a further feature of the invention there is provided an article of reinforced concrete characterised in that the reinforcement is cathodically protected by the method described above.

To avoid passivation of the anode a suitable pH must be maintained around the anode. Although for zinc a suitable pH value is >13.3, or possibly >13.5, and preferably >14, other materials when used as the anode may require other electrolyte pH limits to avoid passivity. In practice while any pH above the "boundary value" at which passivity is likely may be suitable in the short term, it is advantageous to have a pH well above the "boundary value" to start with. During cathodic protection the pH near the anode is likely to drop and so a higher initial pH acts as a reserve to maintain activity over a long period. pH values of 0.2 above the "boundary pH" may be acceptable, but pH values, 0.5, 0.7 and 1.0 or more units above the "boundary pH" are likely to give a better reserve and a better long term performance.

The anode material selected will determine the electrolyte pH required to maintain active corrosion. In general terms the material chosen must be more reactive, and preferably significantly more reactive, than the material forming the reinforcement.

The anode is preferably zinc or zinc alloy but the anode may be aluminium, an aluminium alloy, cadmium, a cadmium alloy, magnesium or a magnesium alloy or another material which has a more negative electrode potential than the reinforcement under the prevalent conditions.

The electrolyte may be for example sodium hydroxide or potassium hydroxide.

Advantageously, in some circumstances, at least one alkali-silica reaction inhibitor is also present, in at least a portion of the electrolyte.

The high pH of the electrolyte may be due, at least in part, to one or more of the alkali-silica reaction inhibitors.

Preferably at least one of the alkali-silica reaction inhibitors is provided in an hydroxide form. Most preferably the, or one of the inhibitors is lithium hydroxide, which can also function as the electrolyte itself.

The electrolyte solution may be the pore solution of the concrete and/or the pore solution of a mortar, paste or other porous material applied to the concrete being protected.

The method may be practised during the course of repairing reinforced concrete by connecting one or more sacrificial anodes to the reinforcement and applying repair material and the electrolyte to the repair site.

Preferably the anodes are provided in the vicinity of the repair site. If the anode is provided away from the repair site there is likely to be a loss of efficiency due to the extra circuit length required to complete the galvanic cell. Most preferably the anodes are provided near the periphery of the repair site. The anodes are preferably in the new material of the repair site. There may be many anodes. The anode or anodes may have a relatively large surface area and for example could be a mesh or wire (or wires) extending adjacent to the periphery of the repair site.

Preferably each anode is substantially enclosed in repair material containing an electrolyte of high pH. The portion of repair material away from the anode may have a different pH compared with the portion of repair material substantially enclosing the anode. The repair material away from the anode may have a pH that is relatively moderate or low compared with that near the anode.

The whole or any portion of the repair material may also contain one or more alkali-silica reaction inhibitors.

Where only a portion of the material contains an electrolyte of high pH and only a portion contains one or more alkali-silica reaction inhibitors the portions may be the same, distinct or overlapping in extent.

Preferably at least one of the alkali-silica reaction inhibitors also contributes to the high pH of the electrolyte.

As well as introducing sacrificial anodes and an electrolyte of high pH to a structure during a repair, potentially along with an alkali-silica reaction inhibitor, this invention is also applicable to the construction of new reinforced concrete articles or structures and to the improved protection of existing ones.

Just as during repair, anodes and a suitable electrolyte can be provided in electrical contact with the reinforcement to form a galvanic cell, so a similar arrangement can be generated during construction.

The entire structure can be provided with a suitable electrolyte, or merely that portion in the vicinity of the anode can be so provided.

In the construction of new reinforced concrete articles or structures one or more sacrificial anodes can be connected to the reinforcement, a material containing the electrolyte cast around the anode or anodes and concrete then cast around the electrolyte-containing material.

In the improvement of the protection of existing concrete articles one or more sacrificial anodes can be inserted in a hole in a mass of reinforced hardened concrete and connected to the reinforcement and then surrounded by a material containing the electrolyte.

In both methods the material containing the electrolyte can be a non-cementitious material or a cementitious material.

One or more of the sacrificial anodes may be introduced to the repair site as a pre-formed unit comprising an anode in contact in use with a porous material containing an electrolyte of high pH. The material may also contain one or more alkali-silica reaction inhibitors. The unit may have an anode substantially enclosed in porous material of high pH.

The sacrificial anode may be at least partially enclosed in the material. Only a portion of the material which contacts the anode may contain an electrolyte of high pH. Of course more than one anode could be provided in each unit.

The unit may comprise a container holding the material and the anode. The unit may be ready for introduction to a repair site, or may require some local treatment (for example wetting). The unit may comprise a bag or sock which contains the high pH material and an anode.

It is possible to provide a localised area of high pH adjacent or around the anode and this will probably occur in patch repair automatically. However it may be desirable to have a region of higher pH even when making original concrete articles.

BRIEF DESCRIPTION OF THE DRAWINGS

Embodiments of the invention will now be described by way of example only, with reference to the accompanying drawings, in which.

DETAILED DESCRIPTION OF THE INVENTION

Chloride-contamination of concrete structures can cause significant corrosion in reinforced structures. Such corrosion is often localised and can cause cracking of concrete surrounding the reinforcement. It is normal to treat problems of local corrosion-induced cracking in reinforced concrete structures primarily by removing the affected material and patching with fresh cementitious mortars or concretes. A common difficulty which arises in such cases is that failure to detect and remove all chloride-contaminated concrete from around the corrosion-damaged areas can result in the formation of so-called "incipient anodes" on the reinforcing steel in the vicinity of the repair patches, which are electrically coupled to cathodic steel situated in the repaired areas themselves. This can lead to rapid corrosion at the "incipient anodes" and to eventual cracking of the concrete around the repaired areas.

However, if having removed the contaminated and cracked concrete from around the reinforcement in regions of the structure where corrosion has been detected or where chloride salts have been found in significant concentrations, the exposed steel is cleaned and connected to zinc-based sacrificial anodes at locations near the periphery of the area to be patched and the repair site is reinstated with mortar (or a similar material) of suitably controlled high pore solution pH, (for example pH >13.3, 13.5 or 14 for zinc or zinc alloy anodes) such problems can be overcome.

Figure 1:
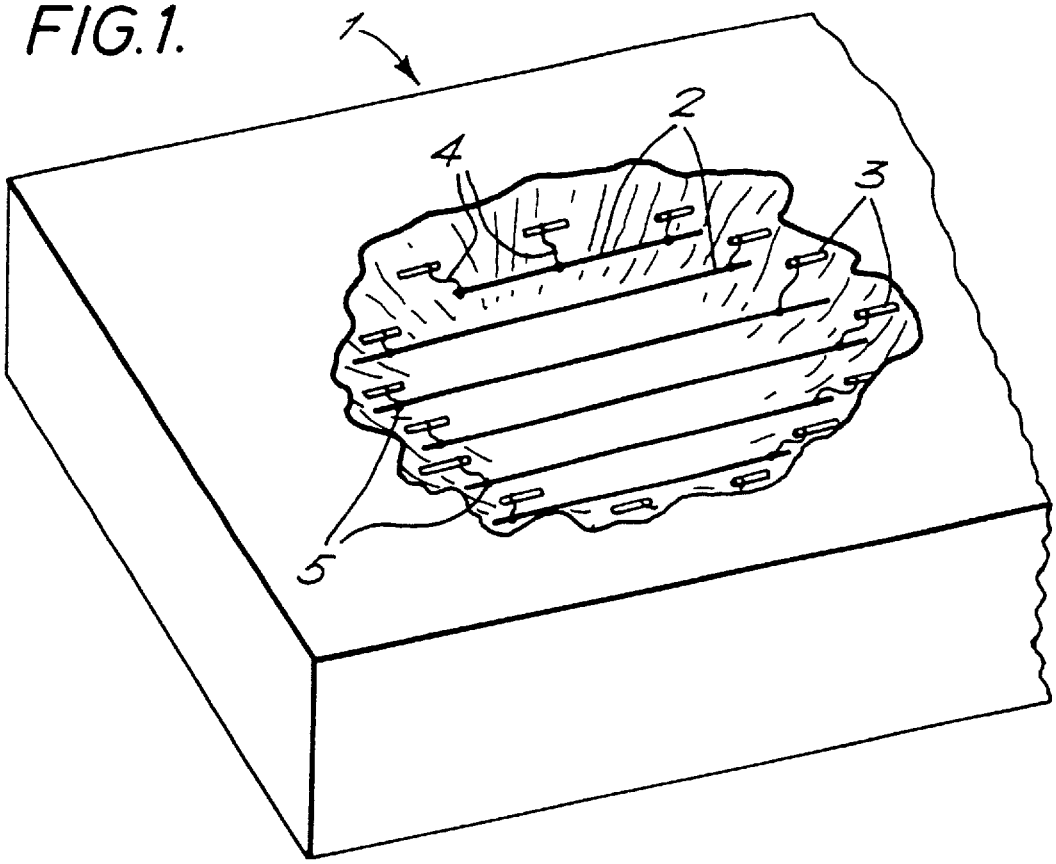
FIG. 1 shows a repair site in a reinforced concrete article, with the reinforcement exposed and sacrificial anodes attached.

FIG. 1 illustrates such a repair where a contaminated volume of concrete has been removed from a concrete slab 1 to leave a void. As a result the reinforcement 2 is exposed. The reinforcement 2 can then be cleaned and a series of zinc anodes 3 can be attached by connectors 4 to the reinforcement at locations 5. The anodes may conveniently be located around the periphery of the area to be protected.

Subsequently repair mortar can be applied to fill the void.

The pore solution of the repair mortar acts as the electrolyte to complete the circuit enabling cathodic protection to take place, with the high pH ensuring that corrosion of the anode and hence the protection is sustainable.

References to pH in the present specification are based on Sorensen's original definition, namely $pH=-\log_{10}[H^+]$ and on the ionic product relationship for aqueous solutions at 25° C.: $[H^+]\times[OH^-]=10^{-14}\ mol^2\ dm^{-6}$. The pH is determined by measuring the hydroxyl ion concentration of the pore solution at about 25° C. and applying the equation $pH=14+\log_{10}[OH^-]$ The pore solution may be extracted by methods known in the art. One such method is carried out at high pressure on the hardened mortar or concrete and is described by Longuet P, Burglen L and Zelwer A in "La Phase Liquide du Ciment Hydrate" Revue des Materiaux de Construction et de Travaux Publics 676, 1973 pp 35–41.

In many cases a pore solution having pH values high enough for use in the above applications may be made either from Portland cements of intrinsically high alkali content (i.e. those containing relatively high proportions of $Na_2$ 0 and $K_2$0 or from cements of lower alkali content with supplementary alkalis (in the form of LiOH, NaOH or KOH for instance) incorporated into the mix materials as admixtures.

In some instances, because the presence of high concentrations of hydroxyl ions in combination with sodium and potassium ions can cause alkali-silica reactions, which can cause deleterious expansion and cracking of the concrete, the presence of an alkali-silica reaction inhibitor is advisable.

Where a potentially reactive aggregate is present the mortar can be made from a cement of relatively low alkali content with lithium hydroxide as an admixture. Typically, this would involve the addition of LiOH to the mix water at a concentration of about 1 mole/litre or higher, which would ensure the maintenance of a high pH value, necessary to sustain the activity of the zinc-based anode, whilst introducing a cation, $Li^+$, that is known to act as an inhibitor of alkali-silica reaction.

The use of lithium hydroxide as admixture is of especial benefit when the mortar, concrete, or the like, has a low Na and K content (or a low Na or K content). $Li^+$ can assist in preventing alkali aggregate reaction.

In a preferred embodiment an excess of solid is provided over that needed to saturate the electrolyte solution, thereby providing a reservoir of electrolyte. More preferably there is an excess of alkali over that needed to saturate the electrolyte, most preferably an excess of lithium hydroxide.

Alternatively other inhibitors may be added to the material in use, for example to the mix water, in conjunction with a pH adjusting reagent.

The inhibition effect of such reagents is aided further in that the current resulting from the cathodic protection encourages migration of the inhibitor to the preferential alkali-silica reaction sites, (where the inhibitor has a positive charge, as is the case for lithium ions). Thus lithium ions migrate over time and there is in use a higher concentration of them where they are desirable.

Figure 2:
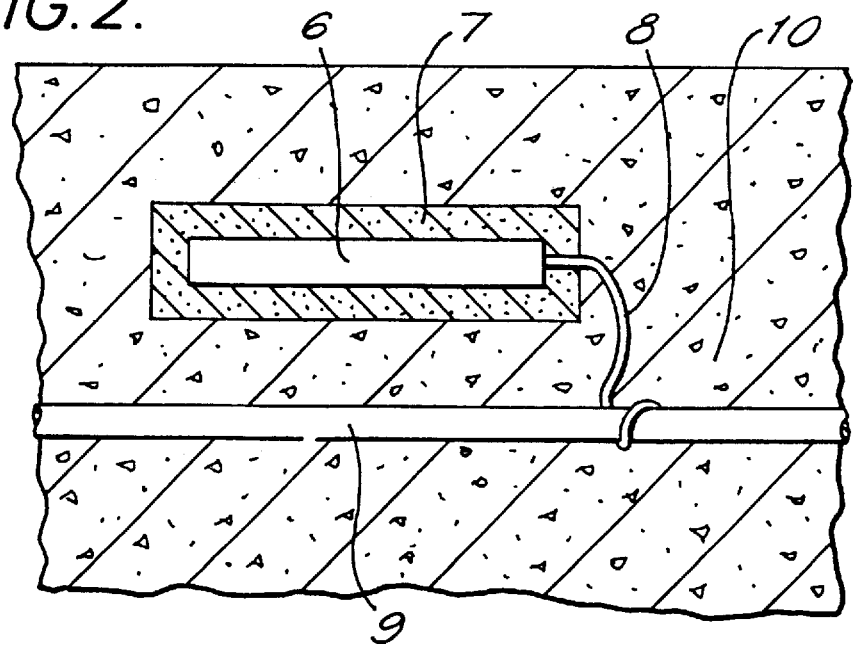
FIG. 2 shows a cross section through a reinforced concrete article with a sacrificial anode unit embedded therein.

As an alternative to (or in addition to) using repair mortars (or similar) of high pH value to reinstate the entire region of removed concrete, it is also possible to utilise sacrificial zinc-based anodes which have been precast in mortars of suitable composition. Such an arrangement is shown in FIG. 2, where a sacrificial anode 6 is almost entirely enclosed in a block of precast mortar 7 to form a discrete unit. A connector 8 allows connection of the anode to the reinforcement 9 in use.

The mortar 7 contains an electrolyte of a sufficient pH to ensure that the anode remains active, in use.

Having galvanically coupled the anode to the steel reinforcement reinstatement of the regions to be patched may then be carried out with mortar or concrete 10 of moderate or low alkali content because the sacrificial anode 6 has already been surrounded by mortar 7 containing an electrolyte that will sustain its activity, allowing effective cathodic protection of the steel. Surrounding the anode with high pH mortar is preferred, but it may not be essential to surround it fully.

As well as precast units the provision of porous bags or socks containing an anode and the mixtures for the mortar is envisaged. The high pH electrolyte, with or without alkali-silica reaction inhibitors, may then be added at the location of the structure in question. Other porous material to enclose the anode, for example, foams, plastics, sponges are also envisaged.

To ensure the continued activity of the anode the electrolyte surrounding the anode needs to be at a high pH. A suitable pH for zinc is >14 although pH values >13.3 are believed to work for at least a limited period. However, the remainder of the repair material could once again be of lower or more moderate pH (or could be of the same pH).

If the concrete was judged to be susceptible to alkali-silica reactions then lithium ions or other inhibitors could be provided in the surrounding electrolyte.

If the concrete were judged not to be susceptible to alkali-silica reactions then it may be preferable to use NaOH or KOH (or some other alkali) to produce the high pH rather than lithium hydroxide.

When treating an existing structure without the need for repair, sacrificial anodes can be provided in proximity with a surface of the structure. Mortar, paste or other porous material containing a suitably high pH electrolyte can be introduced to connect the anode to the pore solution of the existing concrete; with the anode connected to the reinforcement to complete the circuit. Alkali-silica reaction inhibitors can also be introduced to the electrolyte and so can migrate into the existing structure because of the galvanic potential.

Instead of providing the anodes in their own pre-cast high pH environment (with or without the presence of alkali-silica reaction inhibitors) it is possible to apply a region of high pH (and/or alkali-silica reaction inhibitors) mortar in the vicinity of the or each anode, and a region of different pH elsewhere (for example as an upper layer on top of a lower layer). The anode would still be in contact with a high pH electrolyte.

The ready made anode unit shown in FIG. 2 comprises a pre-cast concrete block. However other units may be provided, such as for example bags or socks of high pH concrete or mortar which also contain an anode which is in use connected to the reinforcement. The bags may be provided with wet, unset, mortar, or may be provided dry, the user wetting them before use. They may even in some unlikely circumstances be used dry, absorbing the necessary liquid from their surroundings (when they are cast into place). The units would normally also contain a connector to connect the anode to the reinforcement. The anodes may be provided separately from the bags of high pH material and introduced to the high pH material upon installation.

It will also be appreciated that the high pH material in contact with (and preferably surrounding) the anode need not be mortar or concrete, so long as it is permeable to the electrolyte. It preferably has good mechanical strength in use, but not necessarily. In an extreme case it could be spongy.

It will be appreciated that the pH of the concrete, mortar or the like is controlled. This is done either by choosing the composition of the repair material so as to give a suitably high pH, or by deliberately adding admixtures (such as KOH and/or LiOH, and/or NaOH) to give the desired pH. Thus controlling the pH is a step in the method.

The following example will serve to further illustrate the invention.

Mild steel bars 6 mm in diameter were cut into 80 mm lengths, cleaned using 600 grade carbide paper, degreased in acetone and stored in a dessicator for a minimum of 2 days so that a uniform oxide film could develop on the surface. The two ends of the steel specimens were masked using a styrene-butadiene rubber modified cement slurry and epoxy resin in such a way as to expose a 10 $cm^2$ area of the central region of each specimen. The top 3 mm of each specimen was left unmasked to provide an electrical connection during monitoring. These mild steel specimens were individually fixed in a hole on the lids of cylindrical PVC containers (45 mm dia., 75 mm high). Similarly, strips of zinc 1 mm thick 10 mm wide and 80 mm long were prepared in the same way allowing a central region of 10 $cm^2$ to be exposed. These strips were also fixed individually on lids.

Duplicate cement pastes of a 0.5 water/cement ratio and containing 3% chloride by weight of cement as sodium chloride were then produced. The freshly made mix was emptied into the PVC containers in two stages, vibrating after each stage. The lids containing the steel electrodes were then fixed on to the containers and after further vibration of a few seconds for compaction, the cast specimens were allowed to stand for 24 hours in ambient conditions.

After demoulding, the specimens were stored in a 100% relative humidity environment at room temperature. The cement was an ordinary Portland cement of about 0.6% alkali content expressed as $Na_2O$ equivalent. This level of alkali produced a cement paste whose pore-solution had a pH of about 13.6. In the same way the zinc electrodes were embedded in cement pastes containing 0 or 2 molar NaOH or LiOH dissolved in the mix water. Such additions of alkali hydroxides raised the pH of the pore-solution to a level higher than 14.

The corrosion potential of each individual steel or zinc electrode was measured regularly with a voltmeter against a standard saturated calomel electrode rested on a damp piece of tissue paper positioned on each of the cement paste specimens. After three weeks, one of the steel electrodes and one zinc specimen containing 2 molar NaOH were positioned side by side at a distance of around 5 cm in a container able to maintain a near 100% relative humidity and whose base was lined with wet tissue paper. The two electrodes were electrically connected so that a current could pass between them.

The potential of the corroding steel embedded in chloride contaminated cement paste quickly fell to a value lower than −400 mV and oscillated around this value throughout the exposure period of over 300 days. The potential of the zinc electrode embedded in the cement paste without any additions after starting at a very negative potential of around −750 mV gradually climbed to more noble potentials of around −400mV. The similarity of the potential of the two sets of electrodes will restrict the flow of current between them when coupled and protection of the steel against corrosion would be unlikely. Such protection will only be achieved if a significant potential gradient existed between the two metals. The addition of 2 molar sodium hydroxide or lithium hydroxide was able to bring the potential of the zinc to potentials of around −700 mV, values significantly lower than those obtained for the corroding steel.

The coupling of the steel electrode with the zinc embedded in a paste whose alkalinity was enhanced by addition of NaOH resulted in a galvanic current which eventually stabilised at around 2.5 $\mu$A (0.25 $\mu A/cm^2$ or 2.5 $mA/m^2$ of steel area) a level of current normally applied in cathodic protection systems in steel reinforced concrete. The "instant off" potentials of the steel and the zinc electrodes after 275 days were −426 mV and −640 mV respectively.

The potential of the steel after 24 hours of disconnection rose to a very noble value of −207 mV compared to −470 mV of the parallel unprotected steel specimen, indicating a substantial degree of protection of the steel by the zinc anode.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of cathodically protecting steel reinforcement in reinforced concrete, comprising the steps of:

(a) galvanically connecting a sacrificial anode to the steel reinforcement, the anode being of a metal having a more negative electrode potential than that of the steel reinforcement, and (b) casting around the anode a porous material material containing an electrolyte solution with sufficient alkali that corrosion of the anode and substantial protection of the steel reinforcement are maintained and passive film formation on the anode is avoided.

2. A method as claimed in claim 1, wherein the pH of the electrolyte solution is at least 0.2 units of pH above the pH at which passivity of the anode would occur.

3. A method as claimed in claim 2, wherein the pH of the electrolyte solution is at least 0.5 units above the pH at which passivity of the anode would occur.

4. A method as claimed in claim 1, wherein the anode is of zinc or a zinc alloy and the pH of the electrolyte solution is at least about 14.

5. A method as claimed in claim 1, wherein the anode is of aluminium, an aluminium alloy, cadmium, a cadmium alloy, magnesium, or a magnesium alloy.

6. A method as claimed in claim 1, wherein at least one alkali-silica reaction inhibitor is present in the electrolyte.

7. A method as claimed in claim 6, wherein the inhibitor is a source of lithium ions.

8. A method as claimed in claim 7, wherein the inhibitor is lithium hydroxide.

9. A method as claimed in claim 1, wherein there is provided as solid in the porous material an excess over that required to saturate the electrolyte solution to thereby provide a reservoir of electrolyte.

10. A method as claimed in claim 9, wherein there is provided an excess of alkali.

11. A method as claimed in claim 10, wherein there is provided an excess of lithium hydroxide.

12. A method as claimed in claim 1, comprising inserting the anode in a hole in a mass of hardened concrete and casting the porous material containing the electrolyte around the anode.

13. A method of cathodically protecting steel reinforcement as claimed in claim 1, which comprises a further step:

casting concrete around the electrolyte-containing material so that the anode is embedded in the concrete and substantially surrounded by the electrolyte solution.

14. A method as claimed in claim 1, wherein the material containing the electrolyte is a cementitious material.

15. A method as recited in claim 1, comprising repairing corrosion-induced cracked reinforced concrete by the steps of:

(c) removing the corrosion induced cracked concrete to expose the steel reinforcement (d) cleaning the reinforcement and (e) connecting the sacrificial anode to the cleaned reinforcement.

16. A method as claimed in claim 15, wherein the concrete is chloride contaminated and step (c) comprises removing the chloride contaminated concrete.

17. A unit for use in the cathodic protection of steel reinforcement in reinforced concrete the unit comprising:

a sacrificial anode for embedding in the concrete and for connecting to the reinforcement, the anode being formed of a material having a more negative electrode potential than that of the steel reinforcement, and a repair material for repairing concrete cast around the anode such that the anode is substantially enclosed by the repair material, the repair material containing an electrolyte solution having sufficient alkali that when the anode is galvanically connected to the reinforcement, corrosion of the anode and substantial protection of the steel reinforcement are maintained and passive film formation on the anode is avoided.

18. A unit as claimed in claim 17, wherein the anode is enclosed in a block of precast concrete or mortar containing the electrolyte and the anode has a connector for connection to the reinforcement.

19. A unit as claimed in claim 17, wherein the repair material is subjected to a wetting preliminary treatment before the unit is embedded in the concrete and wherein the entire unit is embedded in the concrete.

20. A unit as claimed in claim 17, wherein there is provided as solid in the repair material an excess over that required to saturate the electrolyte solution to thereby provide a reservoir of electrolyte.

21. A unit as claimed in claim 20, wherein there is provided an excess of alkali.

22. A unit as claimed in claim 21, wherein there is provided an excess of lithium hydroxide.

23. A repair kit for corrosion-induced cracked reinforced concrete, the repair kit comprising:

a container;

a sacrificial anode for embedding in the concrete and for connecting to the reinforcement, the anode being of a metal having a more negative electrode potential than that of the steel reinforcement; and a repair material for concrete for contacting the anode and containing an electrolyte having sufficient alkali that when the anode is galvanically connected to the steel reinforcement corrosion of the anode and substantial protection of the steel reinforcement are maintained and passive film formation on the anode is avoided and wherein said sacrificial anode and said repair material are disposed in the container.

24. A repair kit as claimed in claim 23, wherein the anode and the repair material containing the electrolyte are contained in a bag or sock.

25. A repair kit as claimed in claim 23, wherein the repair material contains an excess of alkali over that required to saturate the electrolyte solution.

26. A repair kit as claimed in claim 25, wherein the alkali is lithium hydroxide.

* * * * *